US007096855B2

(12) United States Patent
Renner et al.

(10) Patent No.: US 7,096,855 B2
(45) Date of Patent: Aug. 29, 2006

(54) DEVICE FOR CONTROLLING AND/OR REGULATING THE FUEL QUANTITY SUPPLIED TO AN INTERNAL COMBUSTION ENGINE

(75) Inventors: Gregor Renner, Stuttgart (DE); Ulrich Schmid, München (DE); Winfried Sommerer, Sachsenheim (DE)

(73) Assignee: Daimler Chrysler AG, Stuttgart (DE)

( * ) Notice: Subject to any disclaimer, the term of this patent is extended or adjusted under 35 U.S.C. 154(b) by 0 days.

(21) Appl. No.: 11/127,771

(22) Filed: May 12, 2005

(65) Prior Publication Data

US 2005/0241620 A1 Nov. 3, 2005

Related U.S. Application Data

(63) Continuation-in-part of application No. PCT/EP03/11483, filed on Oct. 16, 2003.

(30) Foreign Application Priority Data

Nov. 15, 2002 (DE) ..... 102 53 297

(51) Int. Cl.
*F02D 41/34* (2006.01)
*F02M 61/16* (2006.01)

(52) U.S. Cl. ..... 123/494; 123/478

(58) Field of Classification Search ..... 123/478, 123/479, 480, 494; 73/119 A
See application file for complete search history.

(56) References Cited

U.S. PATENT DOCUMENTS 3,575,145 A * 4/1971 Steiger ..... 123/494
4,499,876 A * 2/1985 Yamamoto ..... 123/479
4,523,572 A * 6/1985 Staerzl ..... 123/494
4,903,669 A * 2/1990 Groff et al. ..... 123/478
6,681,644 B1 * 1/2004 Rosalik et al. ..... 73/861.57
6,755,077 B1 * 6/2004 Clingerman et al. ..... 73/116
2002/0000216 A1 1/2002 Ismailov ..... 123/305
2002/0014224 A1 2/2002 Ismailov ..... 123/494

FOREIGN PATENT DOCUMENTS

DE 199 45 673 A1 4/2001
DE 199 45 677 A1 6/2001

OTHER PUBLICATIONS

Bergerig O et al."A New Sensor for Continuous Measurement of Fuel Injection Rate and Quantity During Diesel Engine Operation" Advanced Microsystems for automotive applications, Springer, DE, 1998, pp. 233-247, XP000972096, Fig. 1.

* cited by examiner

*Primary Examiner*—T. M. Argenbright
(74) *Attorney, Agent, or Firm*—Klaus J. Bach

(57) ABSTRACT

In a device for controlling the fuel quantity supplied to an internal combustion engine via a fuel supply line and an injection nozzle which includes a nozzle needle and an actuator for controlling the position of the nozzle needle, wherein a sensor for the detection of injection parameters is provided which supplies injection parameter data to a control unit for determining, on the basis of the sensor data, control parameters for the actuator of the injection nozzle, the sensor is a mass flow sensor arranged in the fuel supply line.

7 Claims, 1 Drawing Sheet

DEVICE FOR CONTROLLING AND/OR REGULATING THE FUEL QUANTITY SUPPLIED TO AN INTERNAL COMBUSTION ENGINE

This is a Continuation-in-Part Application of International Application PCT/EP2003/011483 filed Oct. 16, 2003 and claiming the priority of German Application 102 53 297.4 filed Nov. 15, 2002.

BACKGROUND OF THE INVENTION

The invention relates to a device for controlling the fuel quantity supplied to an internal combustion engine, including an injection nozzle needle and means for controlling the position of the valve needle and a sensor for determining the injection parameters.

An accurate metering of the injection of fuel to an internal combustion engine, in particular in the pilot quantity range of 1 $mm^3$, makes it possible to influence exactly the subsequent combustion processes dependent on this injection, for example, an accurate control of combustion to achieve high efficiencies, at the same time with low pollutant values and noise generation, or else the compensation of aging effects. For this purpose, characteristic maps have hitherto been filed, which contain corresponding desired values for the fuel quantity. At the same time, the injection nozzles are subject to the highest possible requirements as to manufacturing tolerances, thus leading to high production costs. Moreover, aging effects cannot be leveled out or can be leveled out only inadequately by the characteristic maps.

DE 199 45 677 C1 discloses an injection nozzle of an internal combustion engine, a sensor for through flow measurement being arranged in the inner space of said injection nozzle. The sensor has a conductor track, the resistance of which is measured. As is known, this resistance is temperature-dependent and therefore changes as a function of the stream or flow velocity of the flowing fuel.

Furthermore, DE 199 45 673 A1 discloses a generic device, in which a sensor for measuring the fuel through flow and/or other state parameters of the fuel is provided in the inner space of the injection nozzle or in the space outside the latter. The sensor is coupled to a control loop for controlling the injection quantity.

It is the object of the invention to provide a simple device which can be easily produced and by means of which an improved determination of control parameters for the control member of an injection nozzle is provided.

SUMMARY OF THE INVENTION

In a device for controlling the fuel quantity supplied to an internal combustion engine via a fuel supply line and an injection nozzle which includes a nozzle needle and an actuator for controlling the position of the nozzle needle, wherein a sensor for the detection of injection parameters is provided which supplies injection parameter data to a control unit for determining, on the basis of the sensor data, control parameters for the actuator of the injection nozzle, the sensor is a mass flow sensor arranged in the fuel supply line.

Using a miniaturized mass flow sensor and control unit, the fuel injection quantity and also the fuel injection quantity profile can be influenced accurately. As a result, combustion in the internal combustion engine can be controlled even more accurately and therefore an improvement in the operating behavior and in efficiency, and at the same time a reduction of harmful exhaust gases, can be achieved. The arrangement of the mass flow sensor in the fuel inflow line is particularly advantageous in terms of the available construction space.

If a highly dynamic actuating unit is used for the nozzle needle, then the sensor data detected during an injection operation can preferably also be used for influencing the current injection operation. If the dynamics of the actuator used are not sufficient for this purpose, then the sensor data can be used for determination of preset values for one or more subsequent injections. Using such improved preset values, the outlay in regulating terms during the next injections can be reduced.

Furthermore, the mass flow sensor can be used for fault detection (what is known as onboard diagnosis). In particular, the failure of an injection nozzle or else leakages within an injection nozzle can be detected by means of the determined sensor data. Moreover, such a system consisting of sensor unit and control unit can be employed for the compensation of specimen dispersions, for leveling out engine-related ambient conditions and for the correction of aging phenomena.

The use of an adaptor piece in the fuel inflow line with an integrated mass flow sensor has the advantage of simplified assembly. Moreover, such adaptor pieces can be exchanged or existing injection systems retrofitted in a very simple way.

Further details and advantages may become apparent from the description of the invention on the basis of the accompanying drawing:

DESCRIPTION OF A PREFERRED EMBODIMENT

Figure 1:
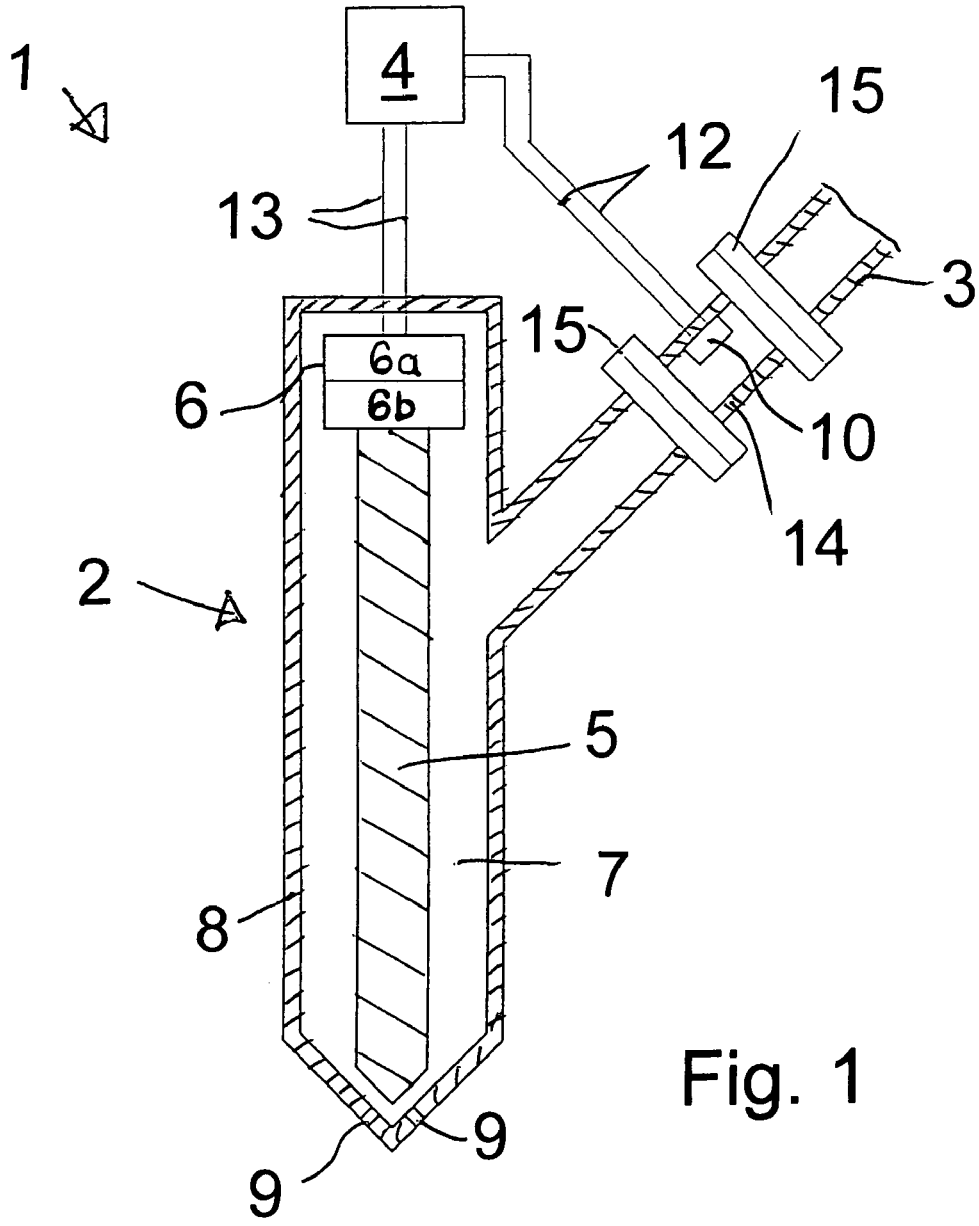
FIG. 1 shows a diagrammatic illustration, partially in section, of an injection nozzle with a sensor arrangement and a control unit.

The device, identified as a whole by 1, for controlling and/or regulating the fuel quantity supplied to an internal combustion engine, not illustrated in detail, has an injection nozzle 2, a fuel inflow line 3 and a control unit 4. The injection nozzle 2, known per se and therefore illustrated only diagrammatically, has a nozzle needle 5 and an associated actuator 6 for actuating the nozzle needle 5. The actuator 6 may, if required, be of two-part design, one part 6*a* of the actuator 6 serving for the rough adjustment of the nozzle needle 5 and therefore for the rough setting of the fuel quantity, while the other part 6*b* of the actuator 6 serves for the highly dynamic adjustment of the nozzle needle 5 and therefore for the fine tuning of the fuel quantity.

The fuel inflow line 3 serves for the supply of fuel from a fuel tank, not illustrated, or from a fuel pump, not illustrated, into an annular space 7 between the nozzle needle 5 and a housing 8 of the injection nozzle 2. Furthermore, one or more injection orifices 9 are arranged in the lower region of the housing 8. These injection orifices are connected to the annular space 7 or closed by means of the nozzle needle 5 as a function of the position of the nozzle needle 5. In the open position illustrated in FIG. 1, fuel can be injected out of the annular space 7 through the injection orifices 9 into the internal combustion engine, not illustrated in any more detail. To terminate the injection operation, the nozzle needle 5 is moved downward with the aid of the actuator 6 and the injection orifices 9 are thereby closed.

A mass flow sensor 10 is arranged in the fuel inflow line 3. The fuel inflow line extends from the fuel pump, not illustrated, as far as the injection nozzle 2. This mass flow sensor 10 is miniaturized to the extent such that it can be integrated into the fuel inflow line 3. At the same time, it must withstand extreme operating conditions. For this purpose, for example, thin film sensors are used. The mass flow sensor 10 is connected to a control unit 11 via signal lines 12. In the control unit 11, a control signal for the actuator 6 is determined from the measurement signal of the mass flow sensor 10 and, if appropriate, from further operating parameters of the internal combustion engine and is transferred to the actuator 6 via corresponding control lines 13. Further operating parameters are detected, for example, with the aid of an air mass sensor in the air inlet duct of the internal combustion engine or via a λ-sensor in the exhaust gas line. Furthermore, for example, the combustion space pressure or the exhaust gas composition can be incorporated into the determination of the required fuel quantity which is carried out in the control unit 4.

To simplify the device 1 further, an adaptor piece 14 inserted by means of connecting elements 15, illustrated diagrammatically, may be provided in the fuel inflow line 3. In this case, the mass flow sensor 10 is integrated into the adaptor piece 14. The connecting elements 15 may in this case be of flange-like design and be connected to one another via screw connections or welded joints. Preferably, however, the connecting elements 15 are designed as plug/screw connections. Since the fuel inflow line 3 is conventionally connected to the injection nozzle 2 likewise via corresponding plug/screw connections, the adaptor piece 14 can be inserted without difficulty. An exchange or the retrofitting of adaptor pieces 14 is in this case possible in a very simple way.

The mass flow sensor 10 determines the fuel mass per unit time, and an additionally integrated pressure sensor may be used for the monitoring of drifts of the mass flow sensor. In most through flow measurement principles, in particular in the thermal through flow measurement principle, the fuel temperature is an important parameter, because it is required for reducing the transverse sensitivities on the mass flow sensor due to temperature fluctuations and consequently also density or viscosity fluctuations. A separate temperature sensor may be used for this purpose. Alternatively, the thermal mass flow sensor may be employed in the temperature-pulsed mode, in order, in the case of a high sensor temperature, to determine the mass flow during the injection operations with high velocity sensitivity and, in the case of a low sensor temperature, to measure the fuel temperature between the individual injection operations with high temperature sensitivity. This measurement strategy, in addition to avoiding the need for an additional temperature sensor, would constitute an energy-optimized operation of the thermal mass flow sensor and make a positive contribution to an increased useful life owing to a lower average thermal load.

In one embodiment, the injection nozzle 2 may have two or more active control members 6*a*, 6*b* for influencing the injection operation or the position of the nozzle needle 5, said control members being operatively connected to the control unit 4.

In this case, the first actuator 6*a* serves for the rough determination of the fuel quantity, while the second, highly dynamic actuator 6*b* serves for the fine tuning of the fuel quantity. The highly dynamic fine tuning of the injection operation makes it possible to influence the profile of the current injection and consequently to determine at any desired time not only the total fuel quantity supplied, but also the distribution of the fuel volume flow over the injection operation. Focal points of the injection are determined flexibly, for example a relatively rapid rise in the fuel volume flow up to a maximum and then a relatively slow fall until the preset total quantity is reached. This arrangement also makes it possible to react to existing manufacturing tolerances of the injection nozzles 2 or of the control members 6*a*, 6*b* and to aging phenomena. A selection of permanently filed characteristic quantities allows this to only a limited extent.

This type of modulation of the injection rate therefore not only makes it possible to divide into preinjection, main injection and postinjection, but also to vary the injection rate during an injection operation. Since the smallest possible fuel quantities in the region of 1 $mm^3$ in the case of injection pressures of 1350 bar or more in common-rail injection systems have to be produced in a stable manner, in addition to an accurate manufacture of the injection nozzles 2, the sensor arrangement according to the invention must compensate the manufacturing fluctuations, the aging phenomena and the external fluctuations in conditions. Such influencing variables are subject to pronounced tolerances which have considerable influence on the injected fuel quantity and can be classified only roughly beforehand. If such fluctuations are not compensated by means of the control, then more stringent requirements must be set with regard to manufacturing tolerances. This increases the production costs. Pronounced tolerances can also be permitted with regard to aging phenomena, as a result of which the useful life of the injection nozzles 2 is increased.

Finally, the device according to the invention can also be used for diagnosis.

The actuators 6*a*, 6*b* may be designed, for example, as piezoelectric actuators or as magnetic actuators. Piezoelectric actuators are at the present time the actuators which switch the fastest. Magnetic actuators have longer switching times. The actuator 6*b* used for the highly dynamic influencing of the fuel volume flow is therefore preferably a piezoelectric actuator. Such actuators 6 are necessary, in particular, when the control unit 4 determines control parameters for the current injection from the sensor data detected during an injection and supplies these control parameters to the actuator 6. If the control unit 4 is to determine control parameters for one or more of the following injections from the sensor data detected during an injection, then magnetic actuators may also be used. In this case, the relatively long switching times of the magnetic actuators would be remedied by means of the sensor arrangement according to the invention, in that the switching times of the magnetic actuators are monitored for each work cycle and preset for the next work cycle.

What is claimed is:

1. A device (1) for controlling the fuel quantity supplied to an internal combustion engine, with an injection nozzle (2) including a nozzle needle (5) and an actuator (6) for controlling the position of the nozzle needle (5), said device having a fuel supply line (3) for supplying fuel to the injection nozzle (2), a mass flow sensor (10) for the detection of injection parameters, and a control unit (4) in which control parameters for the actuator (6) are determined on the basis of the sensor data, said mass flow sensor being a miniaturized thin film sensor (10) capable of withstanding extreme operating conditions and arranged in the fuel supply line (3) to each fuel injection nozzle of the internal combustion engine for determining the fuel mass flow to each individual injector during fuel injection.

2. The device as claimed in claim 1, wherein the control unit (4) determines control parameters for the current injection from the sensor data detected during an injection and supplies these control parameters to the actuator (6).

3. The device as claimed in claim 1, wherein the control unit (4) determines preset values for at least one of the subsequent injections from the sensor data detected during an injection.

4. The device as claimed in claim 1, wherein the control unit (4) is designed for a fault diagnosis based on the sensor data.

5. The device as claimed in claim 1, wherein the mass flow sensor (10) is arranged in an adaptor piece (14) integrated into the fuel supply line (3).

6. The device as claimed in claim 1, wherein a temperature sensor is included in the fuel supply line (3) for determining the fuel temperature.

7. The device as claimed in claim 1, wherein the mass flow sensor (10) is a thermal mass flow sensor operated in a temperature-pulsed mode so as to determine alternately fuel temperature and fuel flow quantity.

* * * * *